US009138084B1

(12) United States Patent
Namolovan

(10) Patent No.: US 9,138,084 B1
(45) Date of Patent: Sep. 22, 2015

(54) MEMORY FOAM PILLOW WITH HERBAL INFUSION

(71) Applicant: 8822077 Canada Corp., Toronto (CA)

(72) Inventor: Krystyna Namolovan, Toronto (CA)

( * ) Notice: Subject to any disclaimer, the term of this patent is extended or adjusted under 35 U.S.C. 154(b) by 0 days.

(21) Appl. No.: 14/684,321

(22) Filed: Apr. 10, 2015

(51) Int. Cl.
*A47G 9/10* (2006.01)
*A47G 9/00* (2006.01)

(52) U.S. Cl.
CPC ..... *A47G 9/007* (2013.01); *A47G 9/1036* (2013.01); *A47G 2009/1018* (2013.01)

(58) Field of Classification Search
CPC . A47G 2009/1018; A47G 9/10; A47G 9/007; A47G 9/1036
USPC ..... 5/636, 639, 640, 490, 638
See application file for complete search history.

(56) References Cited

U.S. PATENT DOCUMENTS 5,953,777 A * 9/1999 Buck ..... 5/636
2003/0217412 A1* 11/2003 Johns et al. ..... 5/636
2010/0175193 A1* 7/2010 Oh et al. ..... 5/638
2012/0073056 A1* 3/2012 Freund et al. ..... 5/639
2013/0098364 A1* 4/2013 Davis et al. ..... 128/206.21
2013/0174344 A1* 7/2013 Klancnik et al. ..... 5/636
2013/0263377 A1* 10/2013 Wootten, Jr. ..... 5/640
2014/0109318 A1* 4/2014 Loos ..... 5/644
2014/0141233 A1* 5/2014 Crawford et al. ..... 428/319.7
2014/0317851 A1* 10/2014 Hammack et al. ..... 5/640

FOREIGN PATENT DOCUMENTS

EP 2130461 A1 * 12/2009 ..... A47G 9/10

* cited by examiner

*Primary Examiner* — Michael Trettel

(74) *Attorney, Agent, or Firm* — James M. Smedley LLC; James Michael Smedley, Esq.

(57) ABSTRACT

The present invention relates to a dual purpose CPAP memory foam pillow that is configured to contain at least three layers of memory foam, at least one of which layer is removable for providing variation in height. The memory foam pillow is comprised of an herbal extract to invoke a soothing ambiance for a peaceful sleep. Furthermore, the memory foam pillow is infused with a cooling gel to absorb aerial moisture.

8 Claims, 2 Drawing Sheets

MEMORY FOAM PILLOW WITH HERBAL INFUSION

FIELD OF INVENTION

The present invention generally relates to memory foam pillows. Specifically, this invention relates to a dual usage memory foam pillow designed to provide a calm and tranquil environment for a more comfortable sleep.

BACKGROUND OF THE INVENTION

Sufferers of breathing problems during one's sleep, such as sleep apnea, use continuous positive airway pressure (CPAP) therapy to assist them in proper breathing. Such breathing problems during one's sleep are characterized by pauses in breathing where such pauses can last for several seconds to several minutes. The pauses in breathing increase the level of carbon dioxide in the blood stream where chemoreceptors sense the increased levels and signal the brain to wake so the user may breath. To treat such a condition, users employ CPAP masks which are intended to deliver constant flow and air pressure so that the user's airways remain open for breathing. However, some users of such CPAP masks face logistical hurdles that make sleeping more difficult.

Users, especially those who sleep on their sides, struggle with keeping the mask in appropriate position. Conventional pillows lack any room for the presence of a face mask so such pillows press and rub against the mask with the effect of displacing the mask. An improperly worn mask may leak due to hose torque and lead to a dry mouth or nose or uncomfortable red marks.

Memory foam pillows are an ideal solution for proper usage and positioning of CPAP masks. Such pillows cradle and stabilize the user's head position for greater support and comfort. Moreover, such memory foam pillows also reduce the interference between the CPAP masks and pillow, thereby minimizing mask shifting, leaks and pressure. Nevertheless, the wearing of a CPAP mask is in itself an unnatural and consequently an uncomfortable endeavor. As a result, although the user of the CPAP mask may be better able to breathe due to the support of the CPAP memory foam pillow, the bulkiness of the CPAP nevertheless postpones the onset of sleep.

Therefore, there is a need in the arts for a memory foam pillow that promotes relaxation and provides for a more soothing experience when employing a CPAP mask during sleep. These and other features and advantages of the present invention will be explained and will become obvious to one skilled in the art through the summary of the invention that follows.

SUMMARY OF THE INVENTION

The present invention provides a memory foam pillow this designed to allow a user of a CPAP mask to sleep more comfortably. Specifically, the memory foam pillow with a dual interface is infused with herbal extracts to provide some therapeutic benefits of aromatherapy.

According to an embodiment of the claimed invention, the memory foam pillow comprises at least three layers of base memory foam material, wherein the first layer has an herbal extract infused therein, wherein the second layer is a removable central layer that provides variability in height, wherein the third layer has a cooling gel extract infused therein; a plurality of aligned perforations passing through said layers and spaced equidistant from one another; a removable inner casing configured to hold said layers together as a single unit; and a removable outer casing comprising extra cushioning on at least one side.

According to an embodiment of the claimed invention, the herbal extract comprises of a green tea extract.

According to an embodiment of the claimed invention, the herbal extract comprises of a lavender extract.

According to an embodiment of the claimed invention, the herbal layer is comprised of five percent or less by weight of said herbal extract relative to said memory foam base.

According to an alternate embodiment of the claimed invention, the memory foam pillow comprises at least three layers of base memory foam material, wherein the first layer has an herbal extract infused therein, wherein the second layer is a removable central layer that provides variability in height, wherein the third layer has a cooling gel extract infused therein; and a plurality of aligned perforations passing through said layers spaced equidistant from one another.

According to an alternate embodiment of the claimed invention, the herbal extract comprises of green tea extract.

According to an alternate embodiment of the claimed invention, the herbal extract comprises of lavender extract.

According to an alternate embodiment of the claimed invention, the first layer is comprised of five percent or less by weight of said herbal extract relative to said memory foam base.

According to an embodiment of the claimed invention, the memory foam pillow comprises at least three layers of base memory foam material, wherein at least one layer is comprised of an herbal extract and a cooling gel extract, wherein the second layer is a removable central layer that provides variability in height, wherein a third layer comprises said herbal extract, said cooling gel extract, or a combination of said herbal extract and said cooling gel extract; and a plurality of aligned perforations passing through said layers and spaced equidistant from one another.

DETAILED DESCRIPTION OF THE INVENTION

The present invention relates to a dual usage memory foam pillows for use with CPAP masks. Specifically, the invention relates to a memory foam pillow with two different sides for offering a plurality of benefits. One face or side of the claimed invention, comprising of herbal extracts, provides aromatherapy benefits to a user, while the opposing side, comprising of a cooling gel, serves as a sweat and moisture absorbing agent. The user has the option of resting one head's on either side of the pillow in accordance with the user's needs.

Figure 1:
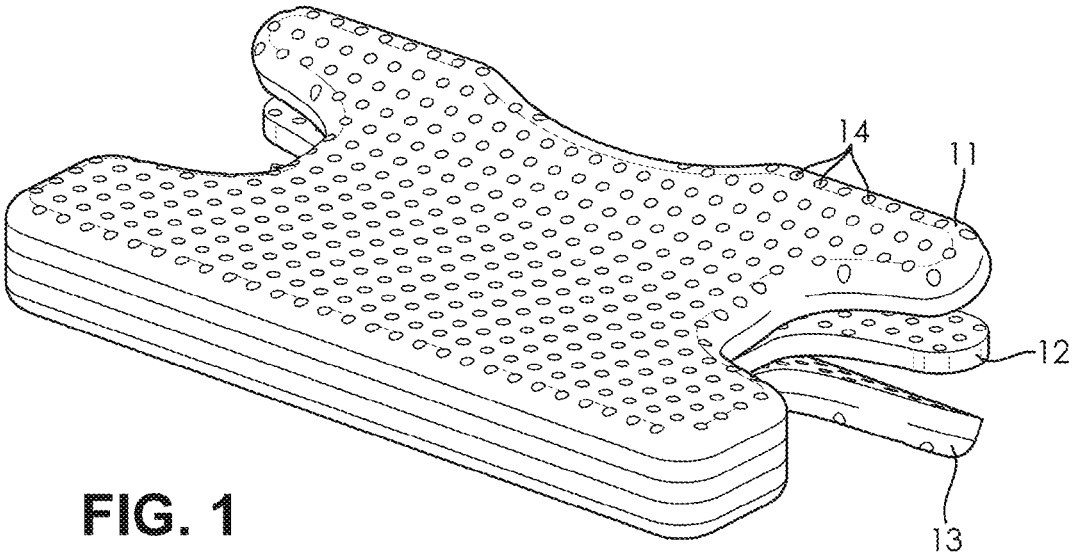
FIG. 1 is a perspective view of the memory foam pillow in accordance with embodiments of the present invention.

According to an embodiment of the present invention, the memory foam pillow comprises of three distinct layers as illustrated in FIG. 1. Each layer serves an important and unique function thereby providing multiple utilities within a single apparatus.

Each layer of the memory foam pillow comprises of a base material of memory foam consisting of a mixture of polyurethane mix, water, and other additives. Memory foam is an ideal material for use as a pillow due its ability to conform to its surroundings, thereby enabling redistribution of weight and surface pressure. Such readjustment provides a more natural rest for the body and contributes to the relief of bodily pains, aches, and soreness.

A first layer (11) of the memory foam pillow is comprised of a base material of memory foam combined with herbal extracts. Such herbal extracts contain essential oils that are inhaled through the nose and influence the endocrine system, which regulates a user's mood. Accordingly, the detection of herbal extracts by the user's brain initiates fundamental hormonal changes that impact physical, mental and emotional wellbeing. In more specific terms, the herbal extracts influence the brain to relax a user's muscles, thereby relieving tension and in turn, promoting a more soothing ambiance.

In a preferred embodiment of the claimed invention, the first layer (11) of memory foam comprises of green tea extract. The extracts of green tea, derived from the tea plant *Camellia sinensis*, promote rest and good health. As examples, the presence of a green tea layer in the preferred embodiment of the claimed invention can be used for the opening of sinuses, preventing cold and flu, boosting the immune system and relieving overall tension. Accordingly, the infusion of green tea extracts within the claimed invention aims to promote a good sleep and/or rest by creating a calm and tranquil environment.

Moreover, the presence of green tree extract serves a secondary purpose of deodorizing the vicinity in which the claimed invention is placed. Odor can be caused by the presence of microorganisms in a favorable environment. As such, green tea has the ability to eliminate mold and moisture, thereby minimizing a suitable environment for odor-causing microbes.

In an alternate embodiment of the claimed invention, the herbal extract used for the first layer is lavender extract. As with green tea extract, lavender can also stimulate calm and is excellent for situations that may induce anxiety, such as wearing a CPAP mask to sleep. The aromatic extracts of lavender are ideal for alleviating headaches and muscular and joint pains.

Other herbal extracts to incorporate within the memory foam may also include peppermint, eucalyptus, lemon, chamomile, cinnamon, tea tree oil, citronella, sandalwood, vanilla, and spearmint. In alternate embodiments one or more herbal types may be used as components of the first layer. The term "herbal" is defined herein as any plant-derived agent. One of ordinary skill in the arts would appreciate that there are many types of herbal agents that can be combined with memory foam, and embodiments of the present invention are contemplated for use with any such herbal extracts.

In a preferred embodiment of the present invention, the mixture of herbal extract and memory foam is 5 parts herbal extract to 95 parts memory foam base. The herbal extract may be added to the memory foam base at any step of the manufacturing process. However, in the preferred embodiment, the herbal extract is in a powder formation. Thus, the composition of the first layer shall comprise of 5% of powdered herbal extract and 95% of powdered memory foam base by weight. In alternate embodiments, a liquid formation of the extract may be used. As an example, oils extracted from such herbs may be used in lieu of the powder variation. In further embodiments, powdered versions of the herbal extracts may be reconstituted in a liquid solution before immersion within the memory foam. If the powdered herbal extract is reconstituted, the same solvents and additives as the memory foam may be used. Alternate embodiments may use 1-10 parts herbal extracts and 99-90 parts memory foam.

A second layer (12) of the memory foam pillow in a preferred embodiment is comprised of a base material of memory foam. As a removable insert, it primarily serves to provide additional height to the memory foam for people with a bigger bodily frame. In one embodiment of the claimed invention, the first layer and the third layer are separate but identically shaped pieces placed together with their faces in contact with one another. If a user wants additional height, a second layer of identical shape and size is inserted between the first and second layer. In other embodiments, the first layer and the third layer are attached along at least one side. Accordingly, the second layer is of a different size and/or shape than the other layers so it may be properly and snugly positioned between such layers. In one embodiment, the second layer is 25 millimeters (mm) thick. Alternate embodiments of the claimed invention may have a second layer that is can be in the range of 15 mm to 40 mm thick.

In alternate embodiments of the claimed invention, the second layer (12) may also comprise of memory foam combined with herbal extract. In one embodiment, the second layer may comprise of the same herbal extract as the first layer. In another embodiment, the second layer may comprise of a different herbal extract than the first layer (11). Embodiments of the central layer may have a composition of herbal extract that is of different proportion of herbal extract to memory foam than the first layer.

In an alternate embodiment of the claimed invention, the second layer comprises of the cooling gel extract infused within the memory foam. In such an embodiment, the level of moisture absorptive qualities is enhanced with the extra layer of a cooling gel infusion. In a further alternate embodiment of the claimed invention, the second layer comprises both herbal extracts and cooling gel extracts.

A third layer (13) of the memory foam pillow is comprised of a base material of memory foam combined with a cooling gel agent. In embodiments of the claimed invention, the cooling gel agent comprises of a powdered blend of herbal extract, (1-3%), bamboo charcoal (2-5%) and mint plant extract (2-10%), where such percentage are relative to the weight of memory foam base. In the preferred embodiment, the cooling gel powdered agent comprises of 2% plant oil, 3% bamboo charcoal and 5% mint plant extract.

The primary purpose of the cooling gel agent is to serve as a desiccator, which is mainly due to the presence of bamboo charcoal. Bamboo charcoal originates from a bamboo plant that has undergone pyrolysis at temperatures between 800° C.-1200° C. After carbonization, the bamboo acquires a highly absorptive ability. Thus, when there is high moisture, such as sweat from the tight sealing of a CPAP mask to a user's face, the bamboo charcoal of the cooling gel is useful is absorbing the discomforting moisture.

The presence of mint extract in the cooling gel serves additional benefits. As with herbal extracts as stated above, the mint extract is able to provide soothing relief and calm to those users experiencing anxiety. Furthermore, the aroma of mint extract has been demonstrated to alleviate inflammation as a result of headaches and migraines. Accordingly, the claimed invention comprises of multiple means of providing a tranquil environment for the user.

In alternate embodiments of the claimed invention, one or more layers may be infused with herbal extracts and cooling gels. In such embodiments the user is able to attain the soothing benefits of the herbal layer and the absorptive benefits of the cooling gel from a single layer.

A beneficial feature of the claimed invention is the adjustable height. Employing the ideal thickness of the claimed invention is important for attaining the proper sleeping posture. Improper spine alignment during one's sleep may affect the muscles, joints, organ and nerves and cause back and neck pain. Accordingly, embodiments of the claimed invention are available in various sizes. In a preferred embodiment, the first layer and the third layer have a thickness of 44.5 mm each. The second removable layer has a thickness of 25 mm in a preferred embodiment. Alternate embodiments of the central layer may range from 10 mm to 40 mm. Accordingly, users of the claimed invention have great flexibility in selecting a memory foam pillow that is most suitable for their sleeping need.

As a CPAP pillow, the claimed invention has indented cutouts at the lateral sides of each layer to accommodate the CPAP mask. Conventional pillows interfere with mask performance. The CPAP mask user, if a side sleeper, directs the hose opening towards the side of the pillow. This either results in (i) the hose bending, leading to mask shift, leaks and facial discomfort or (ii) the CPAP mask user shifting his/her sleeping position on their back, leading to an unnatural and uncomfortable sleeping posture. In turn, the cutouts of the claimed invention provide space for the hose to be tethered to the CPAP unimpeded, thus providing a comfortable sleep and proper employment of the CPAP mask.

Figure 4:
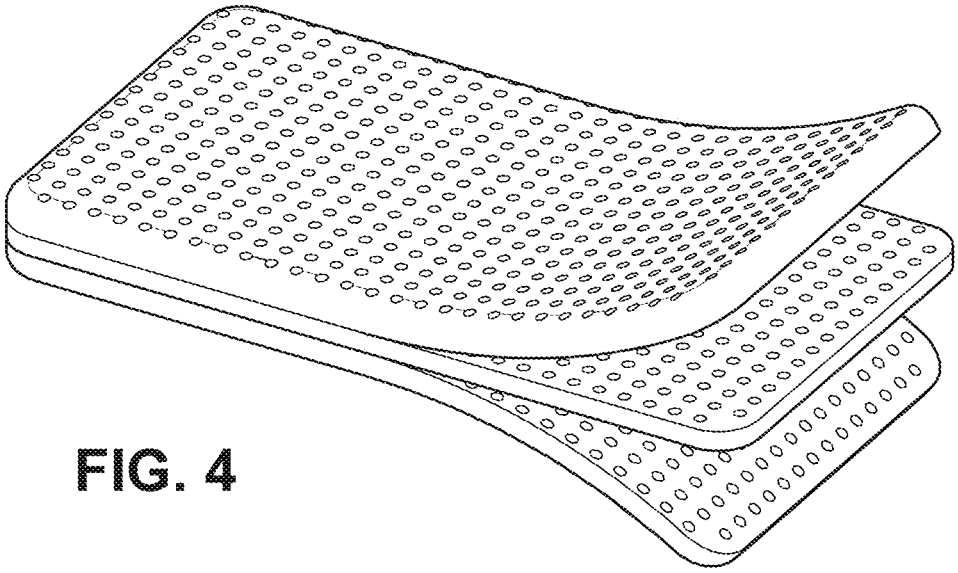
FIG. 4 is a perspective view of the memory foam pillow in accordance with alternate embodiments of the present invention.

According to an alternative embodiment of the claimed invention, the pillow does not have indented cutouts and is in the shape of a conventional pillow, as illustrated in FIG. 4. Such conventional pillow has three layers of memory foam as described herein, and is available in standard, queen and king sizes. The size and shape of the pillow herein is not intended to be limiting feature of the claimed invention.

According to an embodiment of the claimed invention, the pillow includes a plurality of aligned perforations (14) passing through each of the layers, and spaced equidistant from one another. Regularly spaced perforations allow for proper alignment of such perforations among the three layers so that air may flow through and ventilate the entire pillow.

Figure 2:
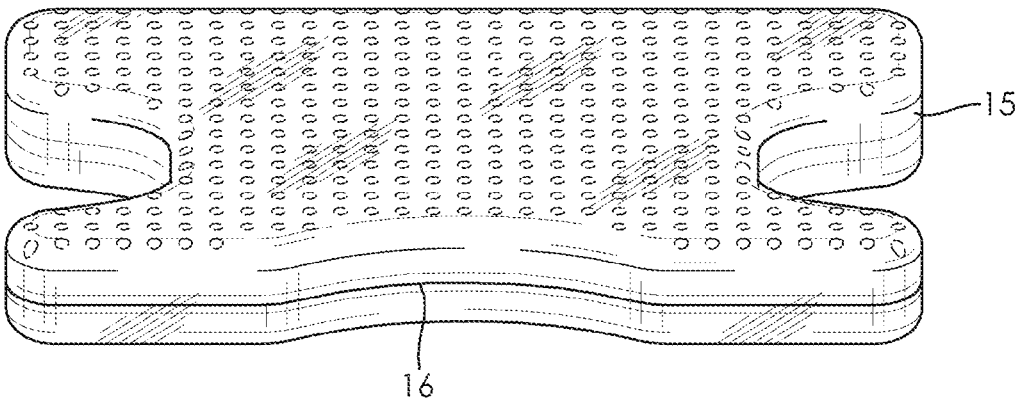
FIG. 2 is a perspective view of the memory foam pillow in accordance with embodiments of the present invention.

According to embodiments of the claimed invention, the three layers of memory foam are held within a removable casing (15) as illustrated in FIG. 2. In certain embodiments, the layers are stacked such that shifting of the layers may occur. Therefore a removable casing configured with a thin zipper (16) is used to house the layers of memory foam. If the user desires to adjust the height of said memory foam, the zipper of said memory permits access within the casing so the second layer may either be removed or inserted. Such casing may be constructed of a variety of thin materials such as cotton, silk, and nylon.

Figure 3:
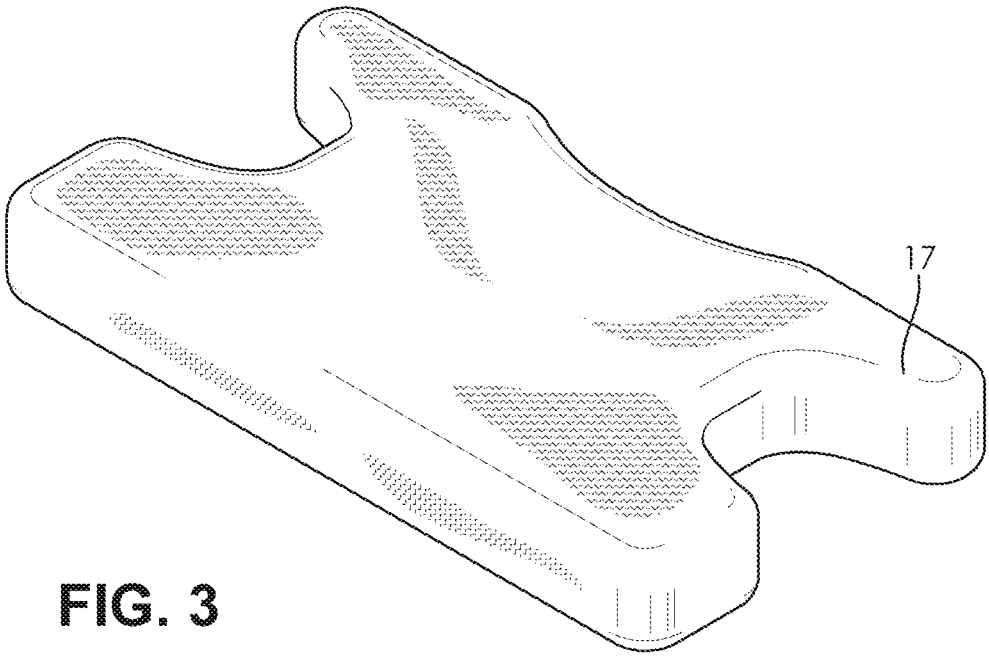
FIG. 3 is a perspective view of the memory foam pillow in accordance with embodiments of the present invention.

According to embodiments of the claimed invention, the three layers of memory foam within the removable casing are further housed in an outer pillowcase case (17) as illustrated in FIG. 3. Such pillow case is constructed of a variety of materials. On the side facing the herbal extract infused layer, this outer pillowcase if further comprised of an additional layer of silk filling to soften this side of the claimed invention. Furthermore, in certain embodiments of the claimed invention, the sides of said outer pillowcase are comprised of mesh fabric.

Embodiments of the current invention are available in low (2.5-3 lbs/ft), medium (3.1-4.9) (lbs/ft), and high (5 lbs/ft+) densities. Users may choose the embodiment that is most suitable for their needs. Low density memory foam has the softest feel but are the least durable. High density memory foams offers supreme support, but it is the slowest to rebound when turning over, thereby interrupting sleep. Medium density embodiments are a satisfactory blend of comfort, support, and durability. In certain embodiments of the claimed invention, the layers may be in different densities. For example, since low density memory foam is cheapest to manufacture, the second layer may be comprised of low density memory foam while the first and third layers are comprised of high density memory foam.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A memory foam pillow comprising:

a first, second and third layer of base memory foam material, wherein the first layer has an herbal extract infused therein, wherein the second layer is a removable central layer that provides variability in height, wherein the third layer has a cooling gel extract infused therein;

a plurality of aligned perforations passing through said layers and spaced equidistant from one another;

a removable inner casing configured to hold said first, second and third layers together as a single unit; and a removable outer casing comprising extra cushioning on at least one side.

2. The memory foam pillow of claim 1, wherein said herbal extract comprises green tea extract.

3. The memory foam pillow of claim 1, wherein said herbal extract comprises lavender extract.

4. The memory foam pillow of claim 1, wherein said first layer is comprised of five percent or less by weight of said herbal extract relative to said memory foam base.

5. A memory foam pillow comprising of:

at least three layers of said base memory foam material, wherein a first layer of said at least three layers has a lavender extract infused therein, wherein a second layer of said at least three layers is a removable central layer that provides variability in height, wherein a third layer of said at least three layers has a cooling gel extract infused therein; and a plurality of aligned perforations passing through said layers spaced equidistant from one another.

6. The memory foam pillow of claim 5, wherein at least one of said three layers comprises of a green tea extract.

7. The memory foam pillow of claim 5, wherein said first layer is comprised of five percent or less by weight of said lavender extract relative to said memory foam base.

8. A memory foam pillow comprising:

at least three layers of base memory foam material, wherein at least one layer of said at least three layers is comprised of an herbal extract and a cooling gel extract, wherein a second layer of said at least three layers is a removable central layer that provides variability in height, wherein a third layer of said at least three layers comprises said herbal extract, said cooling gel extract, or a combination of said herbal extract and said cooling gel extract, and a plurality of aligned perforations passing through said layers and spaced equidistant from one another.

* * * * *